US007362204B2

(12) United States Patent
Concord et al.

(10) Patent No.: US 7,362,204 B2
(45) Date of Patent: Apr. 22, 2008

(54) INDUCTANCE WITH A MIDPOINT

(75) Inventors: Joël Concord, Tours (FR); Olivier Trocherie, Tours (FR)

(73) Assignee: STMicroelectronics S.A., Montrouge (FR)

( * ) Notice: Subject to any disclaimer, the term of this patent is extended or adjusted under 35 U.S.C. 154(b) by 448 days.

(21) Appl. No.: 10/436,961

(22) Filed: May 13, 2003

(65) Prior Publication Data

US 2003/0210122 A1 Nov. 13, 2003

(30) Foreign Application Priority Data

May 13, 2002 (FR) ..... 02 05845

(51) Int. Cl.
*H01F 5/00* (2006.01)

(52) U.S. Cl. ..... 336/200; 336/223; 336/232

(58) Field of Classification Search ..... 336/199–208, 336/223, 232

See application file for complete search history.

(56) References Cited

U.S. PATENT DOCUMENTS 4,959,631 A 9/1990 Hasegawa et al.
5,398,400 A * 3/1995 Breen ..... 29/602.1
6,803,849 B2 * 10/2004 Lowther ..... 336/200

OTHER PUBLICATIONS

French Search Report from French Patent Application 02/05845, filed May 13, 2002.

Patent Abstracts of Japan; vol. 013, No. 132 (E-736), Mar. 31, 1989 & JP 63 299394 A(Matsushita Electric Ind Co. Ltd.).

Patent Abstracts of Japan vol. 1997, No. 07, Jul. 31, 1997 & JP 09 063847 A (NEC Corp.)

Patent Abstracts of Japan vol. 1998, No. 03, Feb. 27, 1998 & JP 09 306738 a(Matsushita Electric Ind. Co. Ltd.).

Patents Abstracts of Japan, vol. 015, No. 269 (E-1087) Jul. 9, 1991 & JP 03/089548 A (Fujitsu Ltd.; Others: 01).

* cited by examiner

*Primary Examiner*—Ramon M. Barrera
(74) *Attorney, Agent, or Firm*—Lisa K. Jorgenson; James H. Morris; Wolf, Greenfield & Sacks, P.C.

(57) ABSTRACT

An inductance with a midpoint formed in a monolithic circuit, comprising a first conductive spiral integrally formed in a first conductive level, a second conductive spiral integrally formed in a second conductive level, and a via of spiral interconnection at the position of the inductance midpoint.

15 Claims, 2 Drawing Sheets

INDUCTANCE WITH A MIDPOINT

BACKGROUND OF THE INVENTION

1. Field of the Invention

The present invention relates to the forming, in a monolithic circuit, of an inductance with a midpoint. The present invention more specifically relates to the forming of a symmetrical inductance. An inductance with a midpoint is formed of a conductive winding, the two ends of which form two terminals of the inductance. A third terminal, also called the midpoint, provides access to another point of the conductive section. In the case of a symmetrical inductance, the midpoint is equally distant from the two end terminals of the conductive section.

2. Discussion of the Related Art

Symmetrical inductances with midpoints are generally used in differential assemblies using outputs in phase opposition. This type of inductance can be found in high-frequency or radio frequency circuits and, more generally, in any differential or balanced circuit requiring accuracy in the symmetry between two inductive elements. For example, this type of inductance may be used in voltage-controlled oscillators (VCO), in phase-locked loops (PLL), in low-noise differential amplifiers (LNA), etc. In this type of application, it is necessary to have a structure as symmetrical as possible to avoid any imbalance or distortion in the circuit exploiting the inductance. This symmetry requires determining, searching, as seen from the internal connection of the winding (midpoint), a path which is identical going to one or the other of the end terminals of the winding. A symmetrical structure also results in a symmetrical electric model which enables avoiding any connection difficulty related to the flow direction of the current.

FIG. 1 shows, in a simplified top view, a conventional structure of a symmetrical inductance with a midpoint, for example of generally octagonal shape. The inductance comprises a first spiral 1 formed in a first metallization level. Spiral 1 connects a first d 4 to midpoint 2 of the inductance. Spiral 1 is cut into several sections 11, 12, interconnected by a connection 13 on a second metallization level via vias 14 between the first and second levels. A second spiral 3 is formed in the same metallization level as the first one. Spiral 3 connects midpoint 2 to a second end terminal 5. Spiral 3 is formed, here again, of sections 31 and 32 interconnected by a connection 33 in another metallization level (the same as that having enabled the forming of connections 13) via vias 34. Connections 13 and 33 provide a regular crossed arrangement of the different sections of the complete winding, resulting in a totally symmetrical structure in which all currents flow in the same direction. Midpoint 2 of the inductance is connected, by a connection 21 in a third metallization level, to the outside of the winding for connection to the other components of the monolithic circuit (not shown). A via 22 connects connection 21 to point 2 in the first conductive level.

A disadvantage of known symmetrical inductance structures with a midpoint is linked to the presence of multiple vias, the number of which increases as the number of turns of the coil of the inductance increases. Indeed, the example of FIG. 1 shows an inductance with three turns of the coil (one turn of the coil and a half for each conductive spiral taken from an end 4 or 5 to midpoint 2) already requiring four vias for the simple crossing of the spiral sections (without taking into account via 22 of connection of midpoint 2 to the outside of the structure). An inductance with five turns of the coil according to such a structure requires eight vias.

A first disadvantage of vias is that they form resistive elements that increase the series resistance of the winding. This adversely affects high-frequency operations for which inductances formed in a monolithic circuit are generally intended.

The problem of the series resistance introduced by the vias implies that, in practice, the maximum number of turns of the coil is generally of five turns of coil (eight vias for the sole conductive circuit sections).

A second disadvantage is the very size of the vias which conditions the minimum dimensions of the inductive structure. In particular, the necessary diameter of the vias imposes a minimum track width (and accordingly a step between tracks) which is greater than the via dimension.

This dimension problem conventionally makes the forming of symmetrical inductive structures with a midpoint almost impossible in integrated circuits for which a thick dielectric (on the order of from 5 to 10 μm) with a low electric permittivity enabling significant reduction of stray capacitances and of coupling phenomena between metallizations, necessary to this type of application, is used. The fact that the dielectric is thick makes the forming of openings (and thus of vias) therein more difficult. For example, for a dielectric of a thickness on the order of 10 μm, the diameter necessary for the via opening is of 50 μm, which imposes a significant track width, generally incompatible with an integration of the circuit in a reduced surface area.

SUMMARY OF THE INVENTION

The present invention aims at providing a novel structure of an inductance with a midpoint which overcomes the disadvantages of known structures.

The present invention aims in particular at providing a structure that reduces or minimizes the number of vias between the conductive levels to form a symmetrical inductance with a midpoint.

The present invention particularly aims at providing a solution which is compatible with current manufacturing processes and especially with an integration of inductances in radiofrequency applications requiring use of thick dielectrics.

The present invention also aims at providing a solution which enables reducing the surface area taken up by the inductance with a midpoint, by allowing a decrease in the widths of the turns of the coil.

To achieve these and other objects, the present invention provides an inductance with a midpoint formed in a monolithic circuit, comprising:

a first conductive spiral integrally formed in a first conductive level;

a second conductive spiral integrally formed in a second conductive level; and a via of spiral interconnection at the position of the inductance midpoint.

According to an embodiment of the present invention, the two spirals are not superposed.

According to an embodiment of the present invention, the inductance comprises, in a third conductive level, a track of contact recovery with the outside of the structure, said track being connected to said midpoint.

According to an embodiment of the present invention, the two spirals are, in a plane, symmetrical with respect to a line crossing the midpoint and the center of the structure.

According to an embodiment of the present invention, at each half turn, each spiral undergoes a transition generating an insulated overlapping between the spirals.

According to an embodiment of the present invention, the transitions are aligned with the midpoint.

According to an embodiment of the present invention, the winding is generally circular.

According to an embodiment of the present invention, the winding is formed of rectilinear sections placed end to end.

The present invention also provides a monolithic circuit comprising an inductance.

The foregoing objects, features, and advantages of the present invention, will be discussed in detail in the following non-limiting description of specific embodiments in connection with the accompanying drawings.

DETAILED DESCRIPTION

Figure 1:
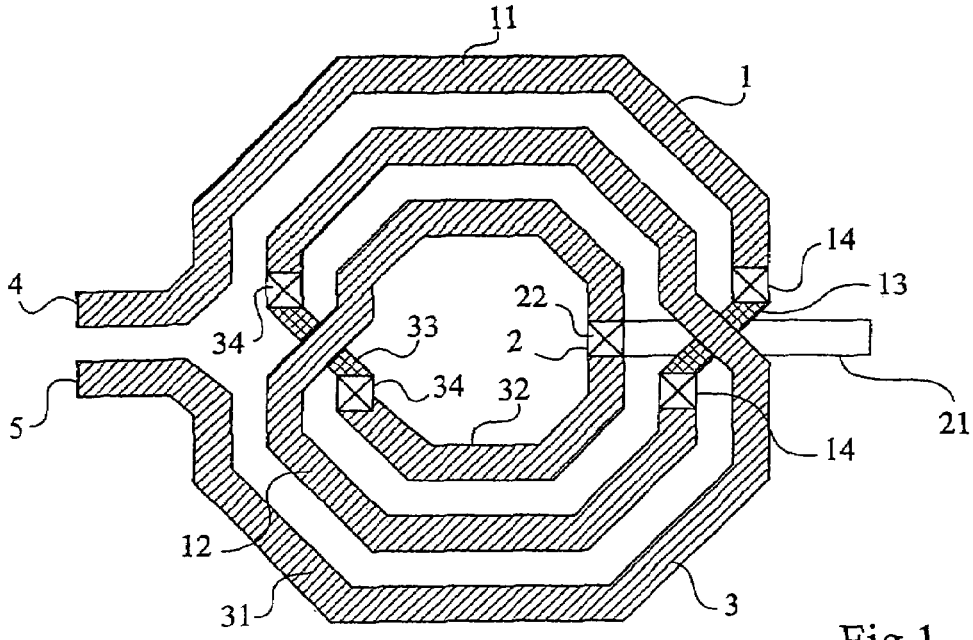
Fig 1 (Prior Art)
FIG. 1, previously described, schematically shows in top view a conventional example of a symmetrical inductance with a midpoint.

For clarity, only those inductance elements and those method steps which are necessary to the understanding of the present invention have been shown in the drawings and will be described hereafter. In particular, the method steps necessary to form the successive conductive and insulating layers have not been detailed and are no object of the present invention. The present invention can be implemented with any conventional method for forming conductive levels with interposed insulators (dielectric).

A feature of the present invention is to use two conductive levels to form the two respective spirals of an inductance with a midpoint. In other words, a first spiral (half-inductance) running from a first end terminal to the midpoint is formed in a first conductive level while the other spiral (running from the midpoint to the other end terminal) is formed in a second conductor, the connection between the two levels being performed at the midpoint.

Figure 2:
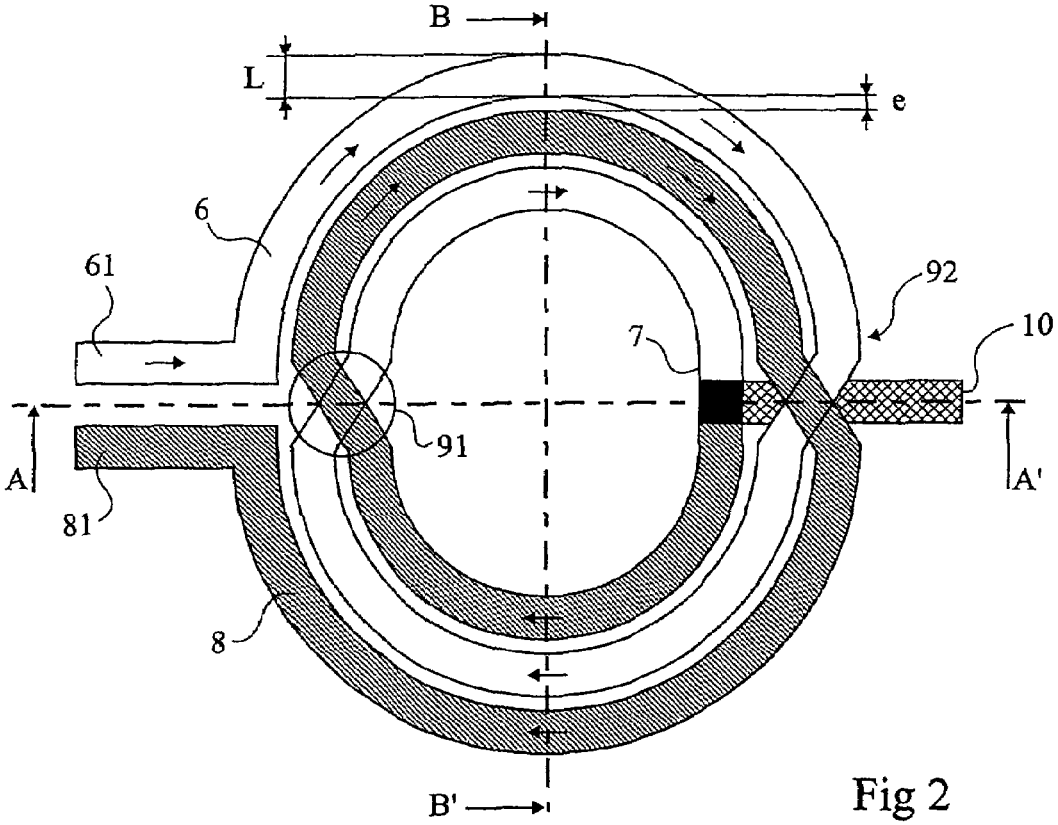
FIG. 2 shows an embodiment of a symmetrical inductance with a midpoint according to the present invention.
Figure 3:
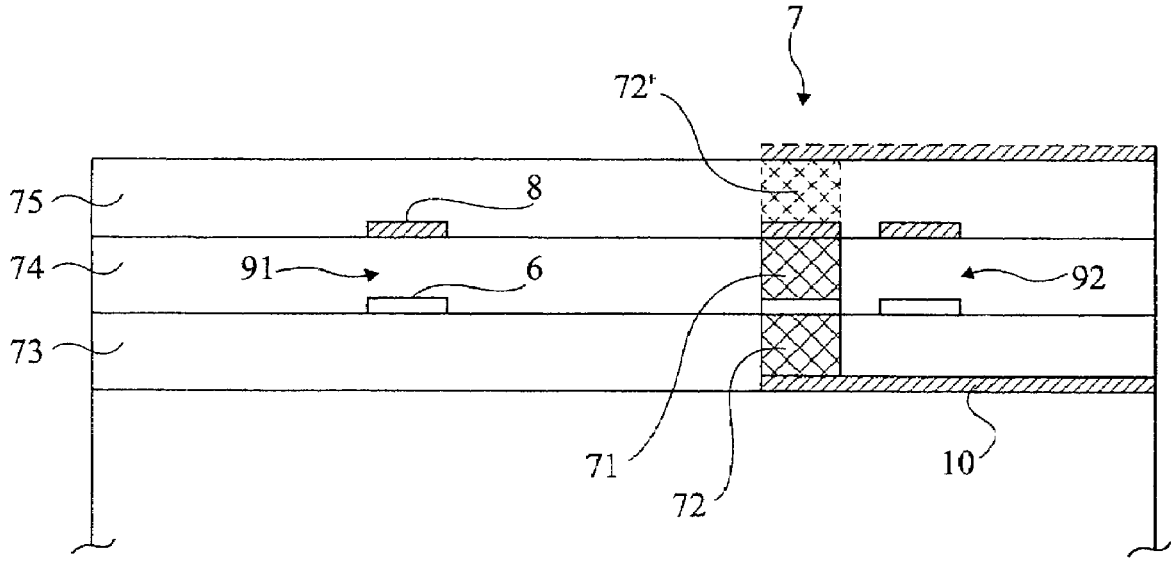
FIG. 3 is a cross-section view along line A-A' of FIG. 2.
Figure 4:
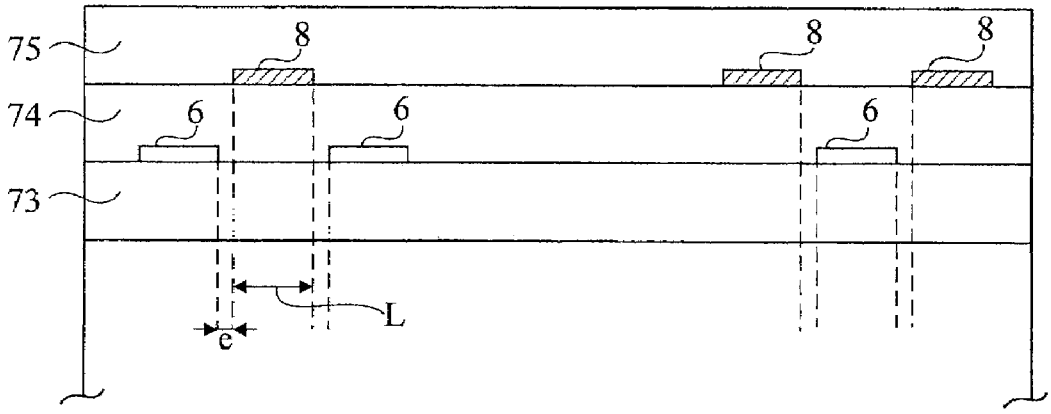
FIG. 4 is a cross-section view along line B-B' of FIG. 2.

FIGS. 2, 3, and 4 show, respectively in a very simplified top view and in cross-section views along lines A-A' and B-B' of FIG. 2, the forming of a symmetrical inductance with a midpoint according to the present invention.

A first spiral or winding 6 starts from an end terminal 61 of the inductance in a first metallization level (illustrated in FIG. 2 by no filling in the section). Spiral 6 is, conversely to conventional inductances with a midpoint, integrally formed in a same metallization level (or more generally a same conductive level) from end terminal 61 to midpoint 7 of the inductance. The notion of first level does not necessarily means that it is the first metallization level of the structure, or of the technological piling. The piling order may be different from the numeral order implied in the present description.

A second winding or spiral 8 is formed, integrally, in a second metallization level over- or underlying the first one (in this example, a higher level). Spiral 8 goes from an end terminal 81 to midpoint 7 of the structure. Here again, the second spiral is integrally formed in a same conductive level, that is, without any via.

The connection of the internal ends of windings 6 and 8 is performed by a via 71 crossing, at the level of midpoint 7, a dielectric layer 73 (FIGS. 3 and 4) between the conductive levels in which windings 6 and 8 are formed.

To have the current through the entire structure flow in the same direction, crossings of the spirals must be provided. Indeed, an inductance intended for high-frequency applications must generally minimize the areas of superposition of conductive sections belonging to the two spirals, to minimize capacitive coupling effects which would otherwise occur between the two metallization levels. Accordingly, crossing or transition areas 91 and 92 are provided in the structure, where spirals 6 and 8 overlap. These areas are approximately located on an imaginary line crossing the structure via midpoint 7. These crossing areas do not result in more conductive level superpositions than conventional structures.

The connection of midpoint 7 to the outside of the structure is performed by means of a conductive section 10 in a third metallization level. Section 10 is connected to midpoint 7 by a via 72 crossing a dielectric layer 74 separating the second and third metallization levels. According to the present invention, via 72 is arranged in the alignment of via 71 or is off-centered towards the inside of the winding. In the example shown, vias 71 and 72 are superposed.

In FIG. 3, section 10 of connection to the outside of the midpoint has been made in the form of an underpass. As an alternative illustrated in dotted lines in this drawing, this section may be formed at the front surface of the structure (above an insulating level 75, deposited on the first metallization level and crossed by a via 72').

An inductance according to the present invention may be formed by any conventional integrated inductance forming method. In particular, it applies to any semiconductor (for example, silicon or gallium arsenide) or isolating (for example, glass, quartz) substrate. Any conductive material currently used for an inductive structure may be used to form the spirals. Further, any type of dielectric may be used.

The dimensions given to the turns of coil, be it widthwise or lengthwise, depend on the application and on the integration technology used. It should be noted that, due to the present invention, the spacing (e, FIG. 2) between turns of the coil may be reduced to almost nothing (no spacing, neglecting the mask positioning tolerances) since it is not limited herein to the technological etch minimum between two adjacent metallizations. Thus, the coupling between turns of coil can be increased and the component performances in terms of surface area and response can be improved. Width L of the conductive tracks is now linked to the minimum width allowed by the technology used in involved metallization levels. In particular, symmetrical inductances with a midpoint exhibiting a compact surface area may be formed by means of the present invention whatever the minimum opening dimensions of the dielectrics to form vias.

An advantage of the present invention is that a single via in series with the two spirals 6 and 8 is enough to form the inductance with a midpoint, and this, whatever the number of turns of coil. The only series via of the inductance winding resulting therefrom significantly reduces problems due to the series parasitic resistance in high-frequency applications.

Another advantage of the present invention is that width L of the conductive tracks for forming the structure is independent from the vias. Further, size e of the intertracks is also independent from the size of the vias. The only possible precaution is that via 71 of the midpoint connection can be more bulky than the width of the tracks forming the conductive sections. In this case, it will for example be attempted to house the additional bulk of the via in the middle of the structure. It should however be noted that, even keeping significant track widths, the present invention already enables eliminating vias, and thus solves series resistance problems.

The inductance structure may take various shapes, not necessarily circular. For example, it may be square, even if this is not a preferred embodiment due to corner effects which reduce the quality factor of the inductance. According to another variation, an octagonal structure which improves the quality factor with respect to a square structure while easing its practical implementation (its design) by putting rectilinear sections end to end may be provided.

Of course, the present invention is likely to have various alterations, modifications, and improvements which will readily occur to those skilled in the art. In particular, although a symmetrical structure is a preferred embodiment due to the connection ease that it provides, an inductance with a midpoint in which the lengths of the turns of the coil are different from each other may be formed. In this case, to respect the need for a single via, the length difference between the two spirals will preferably remain smaller than one half turn.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. An inductance with a midpoint formed in a monolithic circuit, comprising:

a first conductive spiral integrally formed in a first conductive level;

a second conductive spiral integrally formed in a second conductive level;

a via of spiral interconnection at the position of the inductance midpoint; and a track of contact recovery with the outside of the structure, implemented in a third conductive level, said track being connected to said midpoint.

2. The inductance of claim 1, wherein the two spirals are not superposed.

3. The inductance of claim 1, wherein the two spirals are, in a plane, symmetrical with respect to a line crossing the midpoint and the center of the structure.

4. The inductance of claim 1, wherein at each half turn, each spiral undergoes a transition generating an insulated overlapping between the spirals.

5. The inductance of claim 4, wherein the transitions are aligned with the midpoint.

6. The inductance of claim 1, wherein the winding is generally circular.

7. The inductance of claim 1, wherein the winding is formed of rectilinear sections placed end to end.

8. A monolithic circuit comprising the inductance of claims 1.

9. A monolithic inductor, comprising;

a first conductive spiral formed in a first conductive level;

a second conductive spiral formed in a second conductive level;

a via connecting the first conductive spiral and the second conductive spiral; and a track connected to the via;

wherein at each half turn, each spiral undergoes a transition generating an insulated overlapping between the spirals.

10. The monolithic inductor of claim 9, wherein the two spirals are not superposed.

11. The monolithic inductor of claim 9, wherein the two spirals are, in a plane, symmetrical with respect to a line crossing the midpoint and the center of the structure.

12. The monolithic inductor of claim 9, wherein the transitions are aligned with the via.

13. The monolithic inductor of claim 9, wherein the winding is generally circular.

14. The monolithic inductor of claim 9, wherein the winding is formed of rectilinear sections.

15. The monolithic inductor comprising the inductance of claim 9.

* * * * *

UNITED STATES PATENT AND TRADEMARK OFFICE

CERTIFICATE OF CORRECTION

PATENT NO. : 7,362,204 B2
APPLICATION NO. : 10/436961
DATED : April 22, 2008
INVENTOR(S) : Joel Concord et al.

It is certified that error appears in the above-identified patent and that said Letters Patent is hereby corrected as shown below:

On the title page, line 2 of the abstract should read:
circuit, including a first conductive spiral integrally Col. 1, line 21, should read:
frequency or radiofrequency circuits and, more generally, in line 41, should read:
Spiral 1 connects a first end 4 to midpoint 2 of the inductance.

Claim 8, col. 6, line 17, should read:
claim 1.

Signed and Sealed this

Eighth Day of July, 2008

JON W. DUDAS
*Director of the United States Patent and Trademark Office*